United States Patent [19]

Wallace et al.

[11] 4,452,098

[45] Jun. 5, 1984

[54] LOCKING AND POSITIONING DEVICE FOR RECLINING SEATS

[75] Inventors: John B. Wallace; Charles G. Pearson, both of Andrews, Ind.

[73] Assignee: General Engineering & Manufacturing Corp., Andrews, Ind.

[21] Appl. No.: 394,497

[22] Filed: Jul. 2, 1982

[51] Int. Cl.[3] ..... G05G 5/06; A47C 1/02

[52] U.S. Cl. ..... 74/531; 188/67; 297/375

[58] Field of Search ..... 297/374, 375, 355; 248/410, 371; 74/531; 188/67

[56] References Cited

U.S. PATENT DOCUMENTS

| | | | |
|---|---|---|---|
| 1,747,505 | 2/1930 | Emmert | 248/410 |
| 1,879,865 | 9/1932 | Wright | 248/410 |
| 2,595,240 | 5/1952 | Glick et al. . | |
| 2,662,585 | 12/1953 | Ozenne . | |
| 3,271,071 | 9/1966 | Tabor . | |
| 3,356,411 | 12/1967 | Homier et al. | 297/374 |
| 3,383,135 | 5/1968 | Posh . | |
| 3,419,306 | 12/1968 | Homier et al. . | |
| 3,734,441 | 5/1973 | Lux | 248/410 |
| 3,874,480 | 4/1975 | Porter et al. . | |
| 3,893,730 | 7/1975 | Homier et al. . | |
| 4,099,777 | 7/1978 | Chekirda | 297/375 |
| 4,387,926 | 6/1983 | Van Eerden et al. | 297/375 |

FOREIGN PATENT DOCUMENTS

| | | | |
|---|---|---|---|
| 279647 | 12/1913 | Fed. Rep. of Germany | 297/375 |
| 1466417 | 12/1966 | France | 297/375 |
| 426880 | 4/1935 | United Kingdom | 248/410 |

*Primary Examiner*—William E. Lyddane
*Assistant Examiner*—Mark W. Binder
*Attorney, Agent, or Firm*—Fraser, Barker, Purdue & Clemens

[57] ABSTRACT

A locking and positioning device for reclining seats including a back member pivotally connected to a seat member for movement between an upright position and various inclined positions. The locking and positioning device includes first and second telescoping members interconnected by a pair of gripping elements which are normally biased into frictional gripping engagement with one of the members for preventing relative movement between the members in either direction of travel between the members. Manually actuatable control member is provided for releasing the pair of gripping elements from gripping engagement with the one member for preventing relative movement between the members in either direction of travel between the members.

2 Claims, 5 Drawing Figures

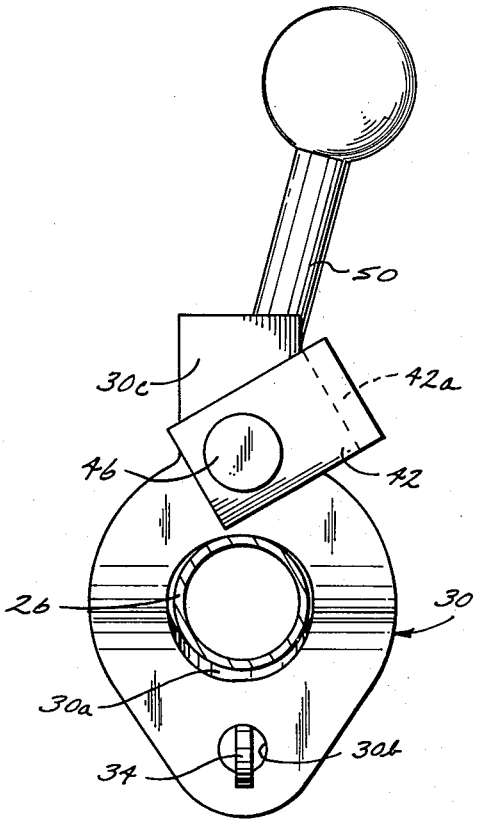
FIG. 3
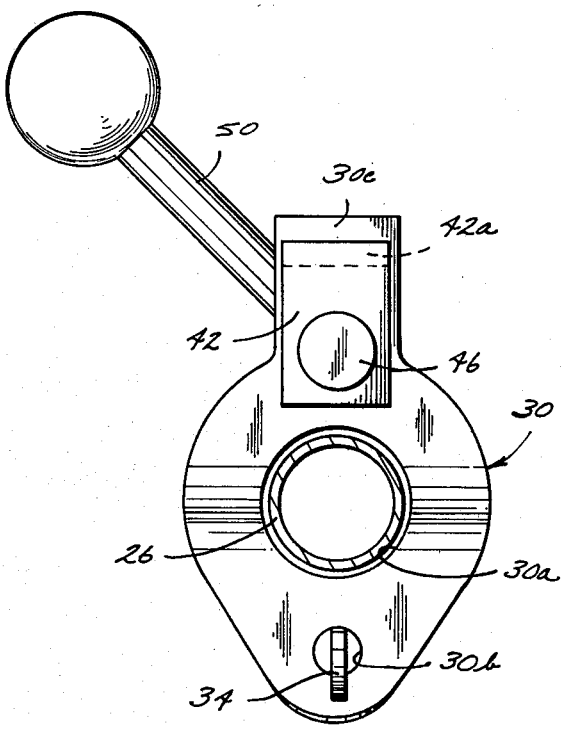
FIG. 5
FIG. 4
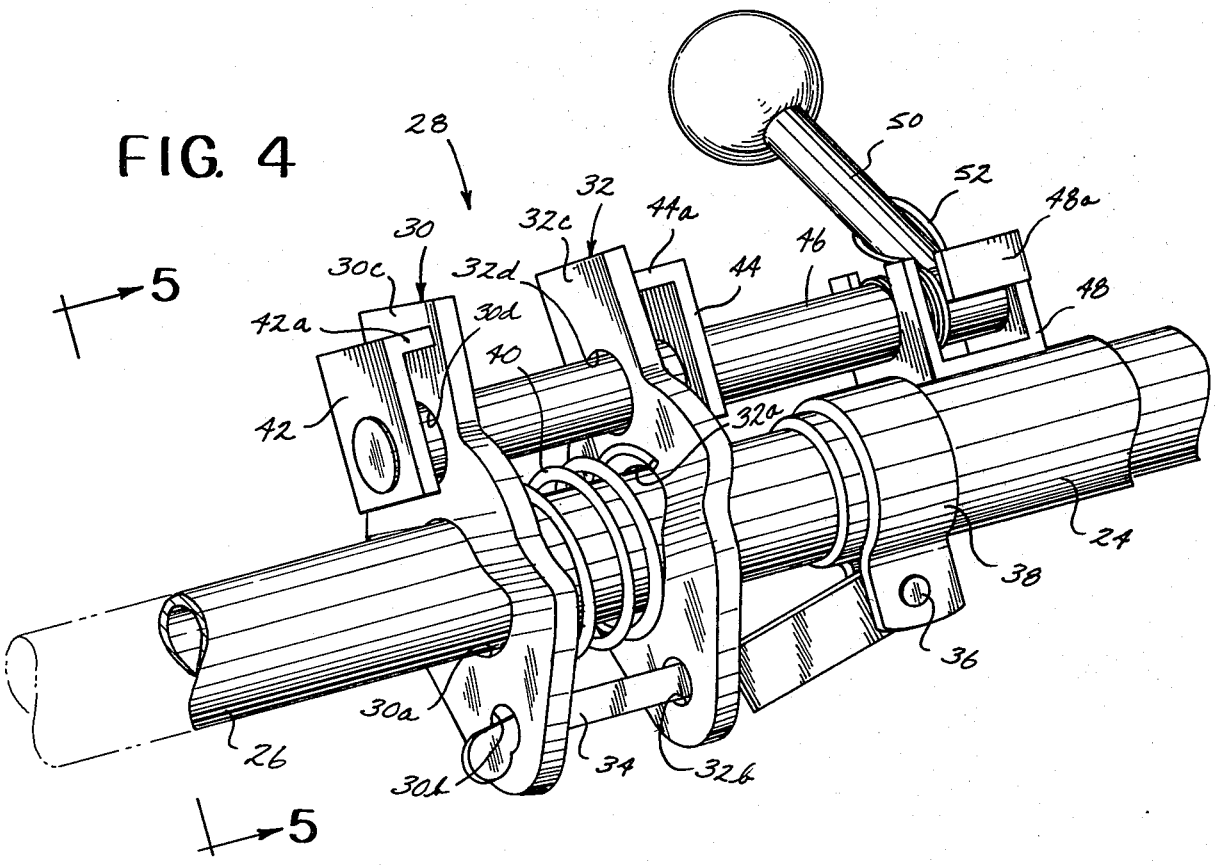

LOCKING AND POSITIONING DEVICE FOR RECLINING SEATS

BACKGROUND OF THE INVENTION

This invention generally relates to reclining seats and, in particularly to a novel locking and positioning device capable of retaining the back members of such seats in an infinite number of inclined positions.

Reclining seats are widely used in airplanes, railway cars, automobiles, vans, buses and the like. Many types of devices for positioning the backs of reclining seats have been produced and examples of such devices are illustrated in U.S. Pat. Nos. 2,595,240; 2,662,585; 3,271,071; 3,383,135; 3,893,730 and 3,419,306.

Typically, the devices illustrated in the above mentioned patents include a pair of elongate members slidably arranged in telescopic relation for movement between extended and retracted positions with respect to each other, and one or more friction washers having a locking position in frictional engagement with one of the members for restraining the associated members against relative movement, and an unlocking position which permits free relative movement between the members. The friction washers are normally biased to the locking position, and released by a cam selectively operable to move the washers to the unlocking position against the biasing action of a spring. Conventionally, the friction washers are mounted on a fulcrum member, and are biased to tilt about the fulcrum member to the locking position. The structure of these prior art devices are complex and costly to produce. Further, these devices have means for locking the telescoping members together in one direction of movement while permitting the members to move relative to each other in the opposite direction of movement. Accordingly, these devices lacked the necessary structures which are required to satisfy the commercial application of their intended use.

SUMMARY OF THE INVENTION

Briefly, the preferred embodiment of the invention includes a pair of elongate members arranged in telescopic relation for movement in extended and retracted positions relative to each. An end of one elongate member is pivotally connected to the seat member of a reclining seat and the opposite end of the other associated elongate member is pivotally connected to an arm depending from and affixed to the back member below the pivotal connection of the seat. Gripping means, comprising a pair of spaced friction applying washers, is carried by one of the elongate members and surrounds the other elongate member. The pair of spaced washers carried on a fulcrum arm extending from one of the elongate members surround the other elongate member and the washers are biased apart to a locked position by a spring disposed therebetween to frictionally retain the elongate members in any selected position between extended and retracted positions in each direction of movement. The washers are compressed by cam members to an unlocked position for permitting free relative movement between the telescoping members.

An object of the invention is to produce a locking and positioning device which utilizes a minimum number of elements and controls movement of telescoping members in both directions.

Another object of the invention is to produce a locking and positioning device which utilizes a pair of friction applying washers which are biased by a spring to assert pressure thereon to instantaneously apply friction to the telescoping members.

A further object of the invention is produce a locking and positioning device which utilizes an actuating lever which simultaneously applies compressive pressure to a pair of friction applying washers for quickly releasing the frictional engagement between the telescoping members.

BRIEF DESCRIPTION OF THE DRAWINGS

The above, as well as other objects of the invention will become readily apparent to one skilled in the art from reading the following detailed description of the preferred embodiment of the invention when considered in the light of the accompanying drawings in which:

FIG. 3 is a enlarged cross sectional view taken substantially along line 3—3 of FIG. 2;

FIG. 4 is an enlarged perspective view, similar to FIG. 2, illustrating the device in the unlocked position; and FIG. 5 is an enlarged cross sectional view taken substantially along line 5—5 of FIG. 4.

DETAILED DESCRIPTION OF THE PREFERRED EMBODIMENT

Figure 1:
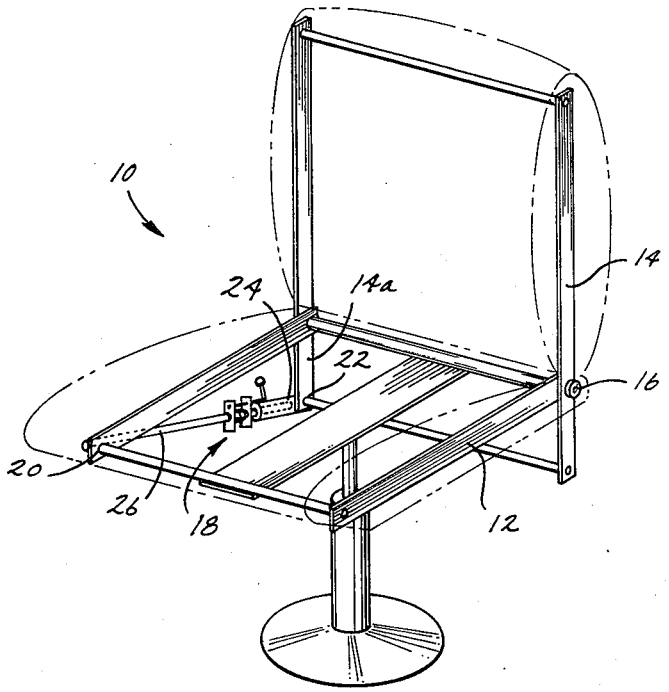
FIG. 1 is a schematic perspective view of a reclining seat assembly incorporating the locking and positioning device constructed in accordance with the invention.

Referring to the drawings, where like reference numerals designate similar parts throughout, there is illustrated in FIG. 1 a reclining seat assembly 10. Seat assembly 10 includes a relatively stationary seat member 12, a back member 14 pivotally connected, as at 16, to the seat member 12, thus allowing the back member 14 to pivot relative to the seat member 12 between an upright position and various inclined positions. A locking and positioning device 18, extending between the front edge of the seat 12 and an arm **14*a* depending from the back member 14, controls the positioning of the back member with respect to the seat 12. The opposed ends of the locking and positioning device 18 are pivotally connected, as at 20 and 22, to the seat and back members 12 and 14**, respectively.

Figure 2:
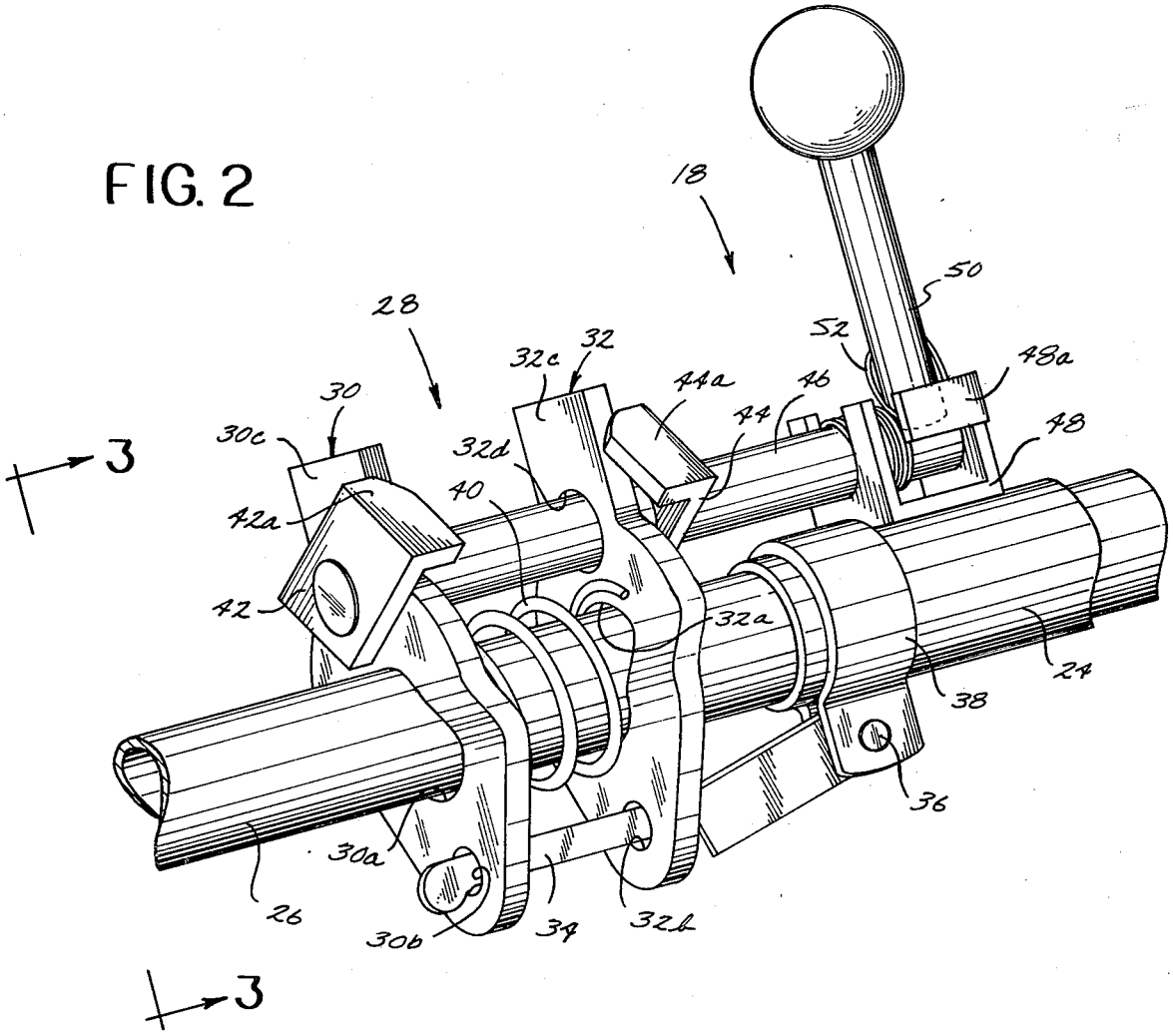
FIG. 2 is an enlarged perspective view of the locking and positioning device illustrating the locked position of the device.

Referring particularly to FIGS. 2 and 4, the locking and positioning device 18 includes first and second elongate tubular members 24 and 26, respectively. As illustrated, the second tubular member 26 is slidably received within the first tubular member 24 for telescoping movement with respect thereto from a retracted position (back member 14 upright) to an extended position (back member 14 inclined).

Carried by the free end of the first tubular member 24 is a gripping means 28 which frictionally grips the second tubular member 26 in selected positions with respect to the first tubular member 24. The gripping means 28 is structured to prevent relative telescoping movement between the first and second tubular members 24 and 26 in either direction. To this end, the gripping means 28 includes a pair of friction washers 30 and 32 adapted to surround second tubular member 26 and arranged to exert pressure in opposite directions parallel to the second member 26 and in directions opposite to both directions of pivotal movement of the back member 14.

More particularly, the washers 30 and 32 are generally elliptical in shape and provided with a central opening 30*a* and 32*a*, respectively, for receiving the second tubular member 26. The openings are larger than the cross-sectional configuration of the member 26 so as to permit annular movement of the washers in order to permit the edges of the openings 30*a* and 32*a* to engage the outer surface of the second member 26 and prevent movement of the member 26 through the washers 30 and 32 to retain the back member 14 in any selected adjusted positions. The washers 30 and 32 each are carried by a fulcrum arm 34 extending through apertures 30*b* and 32*b* provided in the lower end of the washers 30 and 32, repectively. The fulcrum 34 is attached by a nut and bolt assembly 36 to the free end of the member 24 by a clamping collar 38. In this first position, the washers 30 and 32 are repectively urged into edge gripping engagement by a spring 40 surrounding the member 26 and reacting against the opposed facing surfaces of the washers 30 and 32.

The washers 30 and 32 are compressed into a second release position against the action of spring 40 by cam elements 42 and 44, respectively. The cam elements 42 and 44 are provided with portions 42*a* and 44*a*, respectively, extending parallel to the member 26 and adapted to act against the outside surface of tabs 30*c* and 32*c* provided on the upper end of the washers 30 and 32, respectively. The cam elements 42 and 44 are fixedly mounted in spaced relation relative to the washer tabs 30*c* and 32*c* on a shaft 46 for rotation therewith. The shaft 46 extends through apertures 30*d* and 32*d* provided in the water tabs 30*c* and 32*c* and is mounted for rotary movement in a substantially U-shape bracket 48. One end of the shaft 46 is provided with an actuating lever 50 for rotating the shaft between the first and second positions. The actuating lever 50 is urged into the first position by a spring 52 against a stop tab 48*a*. In this position, the cam elements 42 and 44 allow the washers 30 and 32 to be tilted into gripping engagement with the sides of the member 26. The actuating lever 50 is rotatable from the first position to the second position were the cam elements 42 and 44 compressed the washers towards each other to tilt the washers 30 and 32 and thus releasing the gripping engagement of the openings 30*a* and 32*a* from the sides of the tubular member 26 (see FIGS. 4 and 5).

In operation, the back member, when released, may be adjusted to an inclined position by moving the actuating lever 50 into the second position, thus releasing the washers 30 and 32 from gripping engagement as illustrated in FIGS. 2 and 3. When the desired position of the back 14 has been obtained, the lever 50 is released and the member 26 is again gripped by the washers 30 and 32 to hold the back member 14 in the exact position to which it has been moved. The back member 14 may be positioned from an upright position, as illustrated in FIG. 1, to a substantially horizontal position, or an infinite number of positions therebetween.

It will be appreciated from the foregoing description that the locking and positioning device 18 controls movement in both directions of travel of the telescoping tubular members relative to each other. Also, it should be noted that the biasing spring 40 disposed between the two washers 30 and 32 exerts pressure so that frictional engagement with the member 26 is applied without delay. Further, it should be noted that the frictional engagement of the two washers 30 and 32 with a tubular member 26 is simultaneously released.

In accordance with the provisions of the patent statutes, the principle and mode of operation of the invention has been explained and what is considered to represent its preferred embodiment has been illustrated and described. It should, however, be understood that the invention may be practices otherwise than as specifically illustrated and described without departing from the spirit and scope.

We claim:

1. In a locking and positioning device, comprising:

(a) first and second telescoping members adapted for longitudinal movement relative to one another;

(b) gripping means operatively mounted on said first member and moveable to a first position in frictional gripping engagement with said second member for militating against relative longitudinal movement between said first and said second members and to a second position for allowing relative longitudinal movement between said first and said second members, said gripping means including a pair of washers adapted to be spread apart for frictionally gripping said second member in the first position, each said washer includes a portion engageable with said second member;

(c) a fulcrum arm pivotally mounted on said first member, said washers being mounted on said fulcrum arm for movement relative thereto;

(d) means disposed between said pair of washers for biasing said pair of washers apart in the first position, said biasing means including a spring surrounding said second member and operatively disposed between said washers; and (e) means for compressing said pair of washers together in the second position for releasing said second member from said first member whereby said second member may be positioned and retained in any various extended telescope positions relative to said first member, said means for compressing said washers together includes actuatable control means mounted on said first member and engageable with washers for releasing said washers from gripping engagement with said second member, a shaft extending through each washer and a pair of spaced cam members fixedly mounted on said shaft for movement therewith, said pair of cam members containing said pair of washers therebetween and in operative engagement therewith so as to compress said washers upon rotation of said shaft.

2. The invention defined in claim 1 wherein said actuatable control means includes an actuating lever fixedly connected to the end of said shaft and spring means for rotating said shaft and said cam means into the first position for permitting said washers to frictionally grip said second member in the first position.

* * * * *